US008465067B2

(12) United States Patent
Webb et al.

(10) Patent No.: US 8,465,067 B2
(45) Date of Patent: Jun. 18, 2013

(54) INTEGRATION OF VERTICAL ADJUSTABILITY IN AN ELECTRIC STRIKE

(75) Inventors: Michael A. Webb, Phoenix, AZ (US); Joshua T. Peabody, Phoenix, AZ (US); Scott Sullivan, Phoenix, AZ (US); Steve Whisel, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 13/403,590

(22) Filed: Feb. 23, 2012

(65) Prior Publication Data

US 2012/0146341 A1 Jun. 14, 2012

Related U.S. Application Data

(63) Continuation of application No. 12/057,091, filed on Mar. 27, 2008, now Pat. No. 8,146,966.

(60) Provisional application No. 60/920,736, filed on Mar. 28, 2007.

(51) Int. Cl.
*E05B 15/02* (2006.01)

(52) U.S. Cl.
USPC ..... 292/341.15; 292/341.19

(58) Field of Classification Search
USPC ..... 292/137, 341.15, 341.19
See application file for complete search history.

(56) References Cited

U.S. PATENT DOCUMENTS

| | | | | |
|---|---|---|---|---|
| 4,626,000 | A | | 12/1986 | O'Leary |
| 4,626,010 | A | | 12/1986 | Hanchett, Jr. et al. |
| 4,867,496 | A | | 9/1989 | Thomas |
| 5,257,841 | A | | 11/1993 | Geringer et al. |
| 5,595,409 | A | * | 1/1997 | Fier et al. ..... 292/112 |
| 5,757,269 | A | | 5/1998 | Roth et al. |
| 5,934,720 | A | * | 8/1999 | Karalius ..... 292/341.16 |
| 5,990,579 | A | | 11/1999 | Ricci |
| 6,588,155 | B1 | | 7/2003 | Theune et al. |

(Continued)

FOREIGN PATENT DOCUMENTS

| | | |
|---|---|---|
| DE | 10310403 | 9/2004 |
| DE | 102004012112 | 8/2005 |
| DE | 102005048693 | 4/2007 |
| DE | 102007014324.0 | 10/2008 |

OTHER PUBLICATIONS

Cumo, Peter M., Williams, Mark A., "Non-Final Office Action," dated Mar. 24, 2011 in relation to U.S. Appl. No. 12/287,631, Alexandria, VA.

(Continued)

*Primary Examiner* — Carlos Lugo
*Assistant Examiner* — Mark Williams
(74) *Attorney, Agent, or Firm* — Woods Oviatt Gilman LLP

(57) ABSTRACT

An electric strike which provides vertical adjustability of the position of the strike relative to the latch bolt in the closure with modification to the doorframe on the dust box. A ramp element in the strike housing is adjustable relative to the strike and is securable at the time of installation to align the center of the latch bolt and strike. The ramp element has a channel to allow entry and exit of a latch bolt having a dead latch. A keeper engages the dead latch and maintains it in a retracted position when the closure is locked and is released when the electric latch solenoid is energized.

8 Claims, 11 Drawing Sheets

U.S. PATENT DOCUMENTS

| | | | |
|---|---|---|---|
| 6,634,685 | B2 | 10/2003 | Herron et al. |
| 6,874,830 | B2 | 4/2005 | Bashford |
| 6,935,663 | B2 | 8/2005 | Schildwachter et al. |
| 7,144,053 | B2 | 12/2006 | Bashford |
| 7,185,928 | B1 | 3/2007 | Liao |
| 7,722,097 | B2 | 5/2010 | Schnarr et al. |
| 2004/0061343 | A1 | 4/2004 | Bashford |
| 2006/0226663 | A1 | 10/2006 | Liao |
| 2007/0085354 | A1 | 4/2007 | Hirschoff |
| 2008/0224481 | A1 | 9/2008 | Geringer et al. |
| 2009/0072555 | A1 | 3/2009 | Holzer |
| 2009/0188289 | A1 | 7/2009 | Orbeta |
| 2010/0038920 | A1 | 2/2010 | Tsai |
| 2010/0078944 | A1 | 4/2010 | Hirschoff |
| 2010/0096864 | A1 | 4/2010 | Webb et al. |
| 2010/0116006 | A1 | 5/2010 | Huang |
| 2010/0127518 | A1 | 5/2010 | Huang |
| 2011/0031768 | A1 | 2/2011 | Scheffler et al. |

OTHER PUBLICATIONS

Cumo, Peter M., Williams, Mark A., "Non-Final Office Action," mailed on Apr. 1, 2010 in relation to U.S. Appl. No. 12/287,631, Alexandria, VA.

Williams, Mark A., Lugo, Carlos, "Final Office Action," mailed on Sep. 17, 2010 in relation to U.S. Appl. No. 12/287,631, Alexandria, VA.

Hanchett Entry Systems, Inc. "Price List for 900 Series Electric Strike," 2 pages, Jan. 1986.

Locksmith Ledger magazine, pp. 113-114, Feb. 1986.

The National Locksmith magazine, cover, Apr. 1986.

Locksmith Ledger magazine, p. 52, Dec. 1986.

Hanchett Entry Systems, Inc. "Installation Instructions for the 900 Series Strike," 4 pages, Feb. 1986.

* cited by examiner

INTEGRATION OF VERTICAL ADJUSTABILITY IN AN ELECTRIC STRIKE

CROSS REFERENCE TO RELATED APPLICATIONS

This application is a continuation of U.S. patent application Ser. No. 12/057,091, filed Mar. 27, 2008 now U.S. Pat. No. 8,146,966, which claims the benefit of U.S. Provisional Application No. 60/920,736, filed Mar. 28, 2007, both of which are incorporated herein by reference in their entirety.

FIELD OF THE INVENTION

The present invention relates to security devices, and more particularly, to a concealed electric operated door strike for closures using latch bolts.

BACKGROUND OF THE INVENTION

In door or closure openings it may be desirable to automatically release locks having latch bolts or guarded latch bolts from their engagement in the door frame. Latch bolts are carried by a closure such as a door and are received in a strike which is mounted in a recess in a door frame. Guarded latch bolts are comprised of two elements: a latch bolt and a dead latch or latch guard. The dead latch is located directly adjacent the latch bolt and follows the latch bolt as the door or closure swings into its frame or leads the latch bolt when the door or closure swings out of its frame upon opening. The dead latch provides added security against unauthorized entry by use of devices inserted between the frame and the door or closure to depress and thus release the latch bolt.

Electric strikes that automatically release latch bolts may allow the latch bolt to ramp out of the door frame (see U.S. Pat. No. 4,626,010) or incorporate components that pivot away from the latch bolt allowing the bolt to exit the doorframe (see U.S. Pat. No. 5,934,720). Given the nature of the design of a guarded or dead latch bolt, electric strikes that ramp out a latch bolt with the dead latch can only do so if the dead latch component is first allowed to extend into a released or unlock state prior to the latch bolt being ramped out of the doorframe. Once extended to the unlocked state, the dead latch is depressed by the retracting latch bolt. Therefore it is necessary to have ramps on both sides of the dead latch to force retraction of the dead latch by ramping the latch bolt back into the door.

Normal electric strikes of the type that ramp the latch bolt back into the door or closure do not provide allowance for vertical adjustment to align the strike with the centerline of the latch bolt contained in the door. A problem occurs when a door or closure does not properly align with the doorframe causing the misalignment of the door/dead latch with the electric strike resulting in an ineffective or an inoperative strike locking system.

The present invention allows the installer of the strike to achieve vertical alignment of the strike center to the latch bolt and dead latch by a simple adjustment mechanism. The addition of dual ramps (on the strike plate and in the housing) facilitate a smooth and rapid egress of the latch from the strike during the unlocking operation of the strike. Vertical adjustability is achieved by an electric strike body having a housing faceplate, keeper and associated components common to an electric strike and further including a slotted ramp which is adjustable along the strike body and securable at a selected position. The term "vertical adjustability" is used as most enclosures such as doors are vertically mounted. However, it will be apparent that the adjustability features of the invention are applicable to installations in which the closure is non-vertical.

BRIEF SUMMARY OF THE INVENTION

The present invention achieves vertical adjustability of the strike relative to the latch bolt and provides a ramp having a selected egress angle for the latch bolt. The ramp is slotted and is adjustable on the strike body to provide proper clearance for the dead latch when it moves away from the strike cavity as the associated latch bolt proceeds up the ramp. The benefit of the present invention includes: (1) easier installation (no modification to the doorframe or dust box is required); (2) added adjustability; and (3) ramp features that facilitate dead latch and latch bolt egress from the strike body. Without incorporation of vertical adjustability in an electric strike of a concealed type, the frame and door dead latch must align within the tolerance of the design specifications. The ability to compensate for vertical misalignment between the latch bolt, dead latch and the strike body will facilitate installation in the manner mentioned above by eliminating rework or modification of the doorframe and/or dust box. A secondary ramp with a slot for the dead latch is designed as a separate movable element and acts as an egress or exit feature for the bolt as well as providing an effective means to align the clearance gap provided for the dead latch. The vertically adjustable ramp also allows for any mismatch between the strike body and the door latch bolt and dead latch prior to the installation of the strike.

The ramp of the present invention can be used in conjunction with specially designed electric strikes providing additional benefits and features or may be used with standard electric strikes known in the art.

It is the object of the present invention to provide a new and useful means to align the horizontal centerline of the guarded latch pathway in a dual ramping faceplate of an electric strike with the centerline of the latch bolt. Another object of this invention is to provide a compact electric strike that may be installed without modification in the doorframe or dust box of a door having standard ANSI 4⅞" metal frame or ANSI/BHMA A 156/115-W metal frame.

Another object to this invention is to provide a compact electric strike design that will minimize the installation process for a standard aluminum frame, by requiring no modification or cutting of the doorframe face, or lip, during installation.

Another object to this invention is to provide a compact electric strike design that will minimize the installation process for a wood frame, commercial or residential, by requiring no modification or cutting of the doorframe face, or lip, and/or door molding during installation.

Another object to this invention is to provide a compact electric strike design that will minimize the installation process for a standard door mullion, fixed or removable, by requiring no modification or cutting of the mullion face, or lip, during installation.

BRIEF DESCRIPTION OF THE DRAWINGS

The above and other advantages and objects of the present invention will become more apparent in the following description, claims and drawings in which:

The same numerals are used throughout to designate the same or similar components with a letter appended in some cases for delineation.

DETAILED DESCRIPTION OF THE INVENTION

Figure 11:
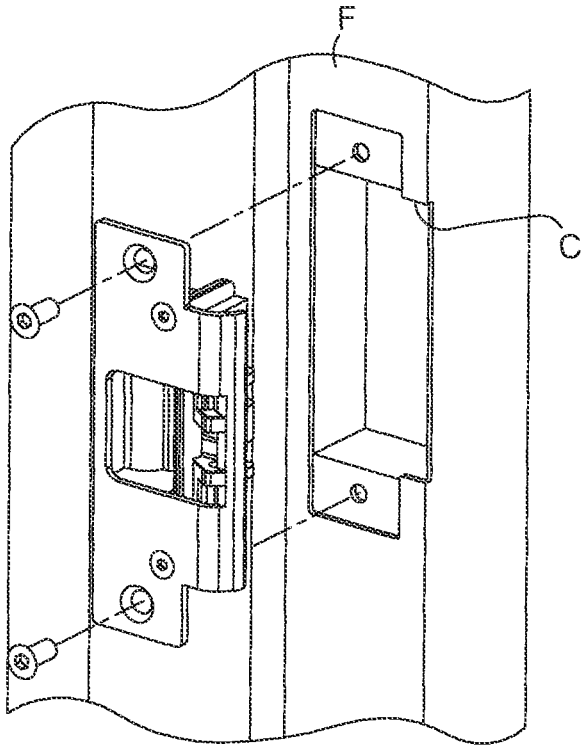
FIG. 11 illustrates the electric strike according to the present invention and an unmodified door jamb capable of receiving this strike without further modification.

To release a latch bolt equipped with a dead latch, the electric strike must first release the dead latch to allow the latch bolt to become depressed into the door. The strike must also provide a pathway or slot to allow the extended dead latch to pass without interference as the door opens. To function properly with the electric strike housing 10 oriented relative to frame F as shown in FIG. 11, the electric strike, the dead latch and the latch bolt must be in proper vertical alignment.

It is common that door and frame installations for the door and frame are not installed perfectly square and aligned on center, thus causing the horizontal centerline of the latch bolt and strike to be misaligned as much as ¼" above the centerline or ¼" below the centerline of the strike. This situation can be further compounded by door sag in the frame occurring after installation.

Figure 12:
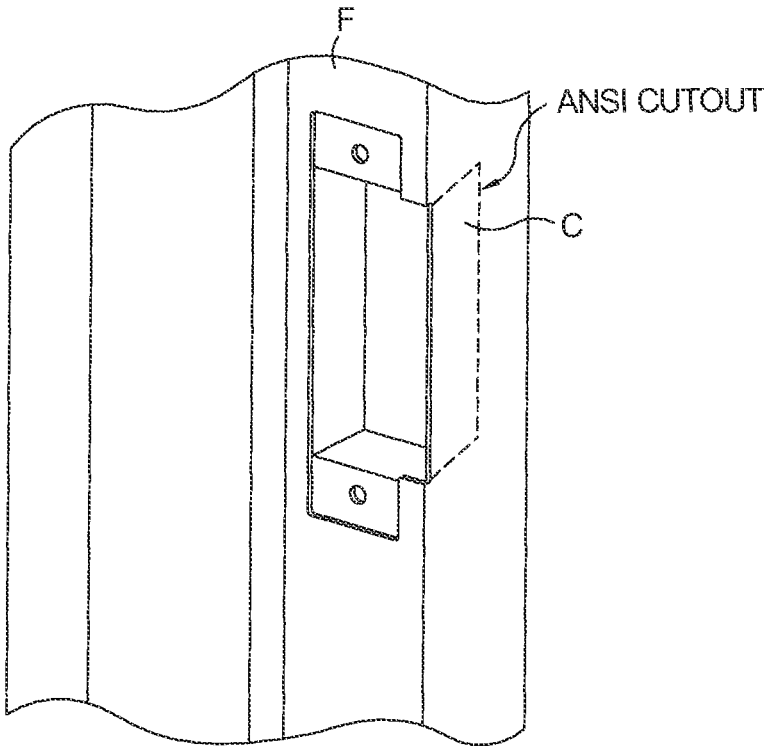
FIG. 12 illustrates the standard frame prep for a metal frame to be used with standard electric strikes.

The present invention provides an adjustment to facilitate installation and ramping to accommodate bolt egress upon opening without involving modification to the doorframe and/or dust box. FIGS. 12 and 11, respectively, represent generally necessary frame preparations for standard electric strikes and those modifications which are avoided by the present invention. The frame and dust box F are provided with a recess or cutout C to accept an electric strike which cutout may conform to a standard such as prescribed by ANSI.

Figure 3:
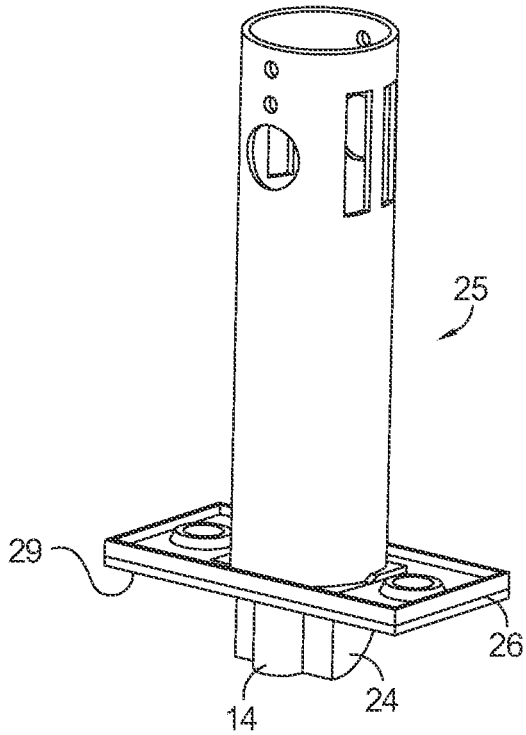
FIG. 3 is a perspective view of a representative latch bolt assembly having a dead latch.
Figure 4:
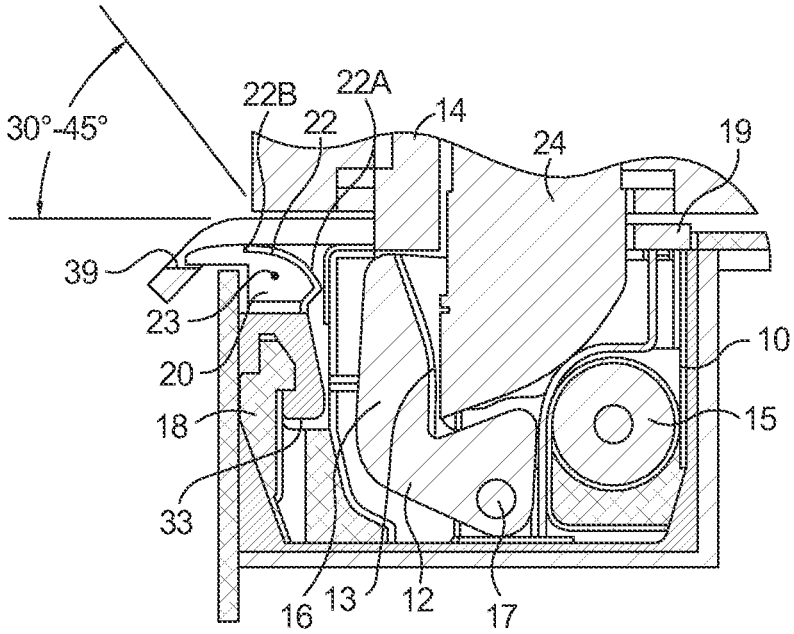
FIG. 4 is a cross sectional view showing the ramp secured on a wall of the strike housing with the keeper engaging the latch bolt in a locked condition and the dead latch retracted to further secure the latch bolt.

Turning now to the drawings, particularly FIGS. 1 to 5, an electric strike housing 10 contains a keeper 12 and associated components such as a solenoid 15, and gears or links that operate the electric strike as known to those skilled in the art. The keeper 12 engages the dead latch 14 of the latch assembly 25 and is released by solenoid 15 through a gear or linkage. The keeper 12 is pivotally mounted at pivot 17 having an arm 16 which maintains the dead latch 14 in a retracted position when the door is locked as seen in FIG. 4. The keeper 12 is rotated to allow the dead latch 14 to extend when the solenoid 15 is energized. The keeper 12 has a generally planar ramp surface 13 along which the latch bolt 24 travels as the door or closure is opened.

The electric strike housing 10 has a sidewall 18 which is recessed below the faceplate 19. The faceplate 19 has a latch bolt receiving opening 38 and a downwardly curved lip or ramp 39. A ramp element 20 has an elongated body which contains a channel 30 defined therein and a longitudinal axis 23. The ramp element 20 is slidably received on edge 21 of sidewall 18 and is adjustable relative to housing 10 and faceplate 19 along longitudinal axis 23 of ramp element 20. Preferably the faceplate and housing are fabricated in accordance with applicable specifications such as ANSI/BHMA A 156, 115-2006 or ANSI/BHMA 156.115-W-2006.

Figure 5:
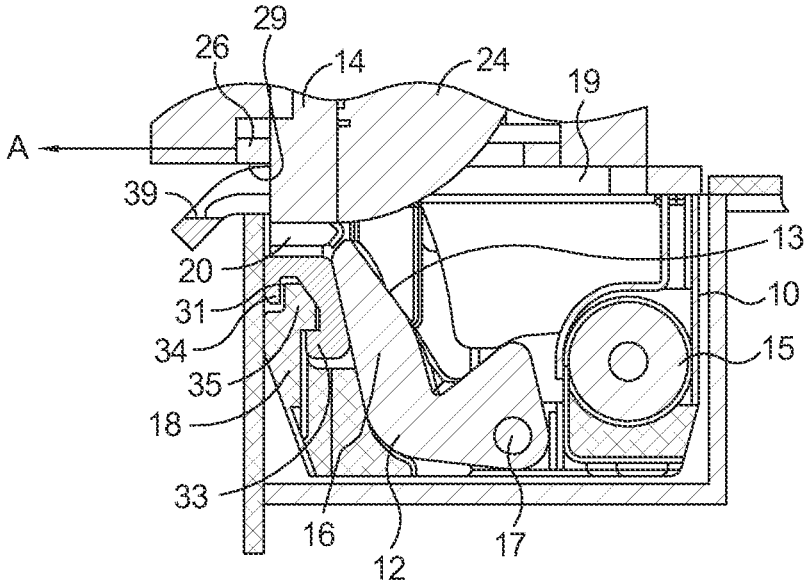
FIG. 5 is a view similar to FIG. 4 with the keeper released and moved to an unlocking position and in shingled position with the secondary ramp, and with the dead latch extended to allow the latch bolt to move up the ramp.

A latch bolt 24 and dead latch 14 form a latch assembly 25 having a faceplate 26, as shown in FIG. 3, which mounts in the edge of a door or closure. Latch assembly faceplate 26 includes a planar surface 29. Ramp element 20 has a ramp surface 22 having a selected profile with a planar entry region 22A followed by a generally curved surface 22B. The planar region 22A defines an angle of between 30° and 45° with respect to the surface of faceplate 19. This angle is critical to proper operation. Keeper 12 and ramp element 20 must meet with a shingling, or overlap, as seen in FIG. 5. The ramp element 20 ramps or depresses the latch bolt 24 away from electric strike housing 10 as the latch faceplate 26 begins to move in direction A (FIG. 5) relative to housing 10 as the door is moved toward a door-open position. Channel 30 (FIG. 1), selectively positionable in a direction perpendicular to direction A and in a plane parallel with planar surface 29 of faceplate 26, is provided in ramp element 20. When channel 30 is properly positioned along longitudinal axis 23 so that channel 30 is aligned with the dead latch 14, a pathway through which the extended dead latch may travel is provided.

Figure 1:
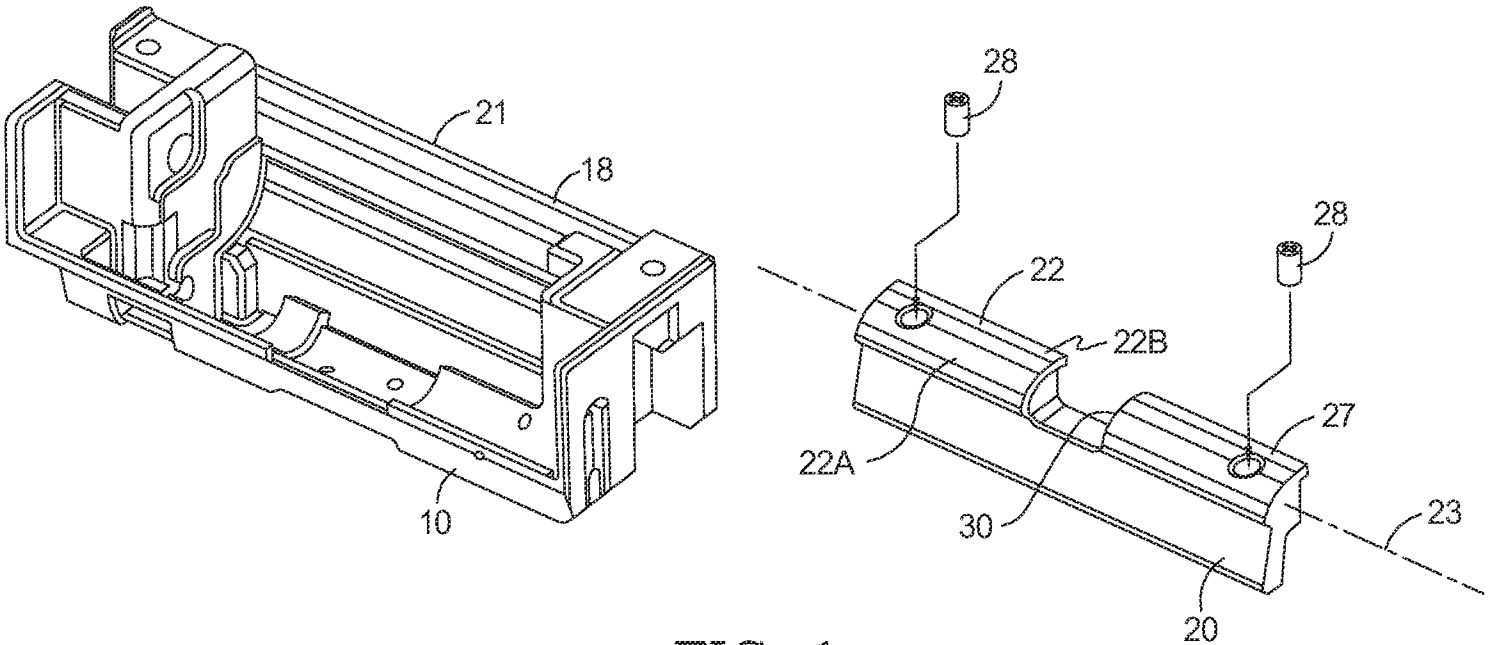
FIG. 1 is an exploded, perspective view showing one embodiment of the electric strike housing and the adjustable secondary ramp according to the present invention.
Figure 2:
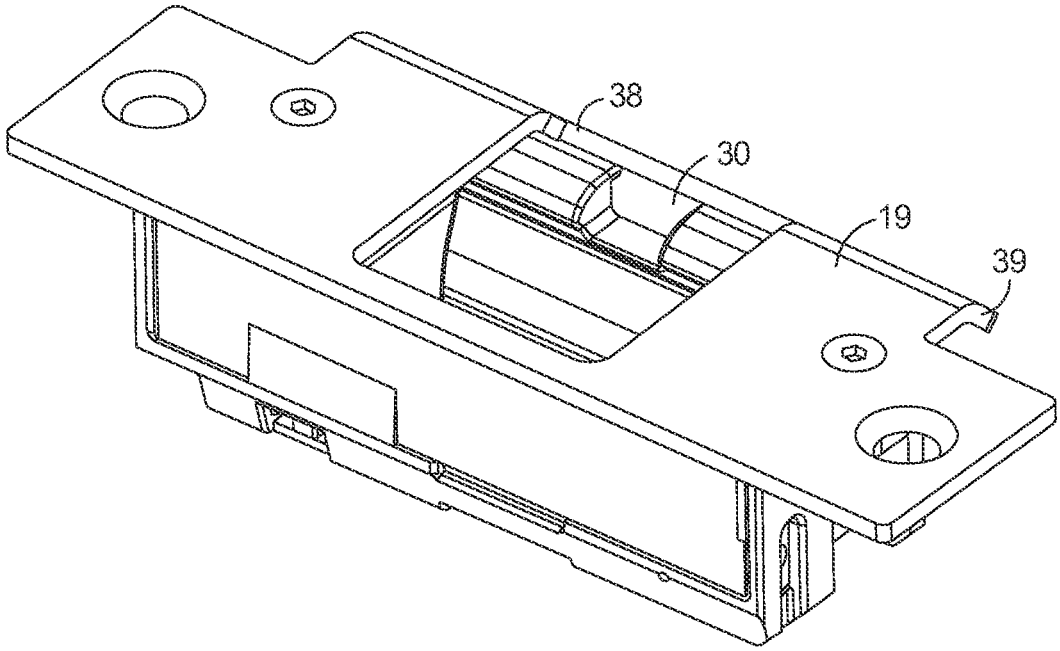
FIG. 2 is a perspective view which shows the adjustable secondary ramp positioned on the strike housing with the face plate attached.

The ramp element 20 may be adjustably securable in place on the strike housing sidewall 18 by various types of fastening arrangements. One arrangement is shown in FIG. 1 in which threaded bores 27 in the top of the ramp receive set screws 28 which are engageable with the strike housing sidewall 18 once the strike has been installed and the ramp is properly positioned on the sidewall to align with the bolt. This arrangement permits incremental adjustment of the vertical location of the channel 30. To cover the full range of vertical adjustment that potentially may be required, the width of channel 30 is selected to be appropriately greater than the width of the dead latch which must pass through it.

The engagement of sidewall 18 and ramp element slot 31 is seen in FIGS. 4 and 5. Preferably the slot 31 has a flange 33 and a projection 34 which engages shoulder 35 on the sidewall 18 although various complementary configurations will be apparent to those skilled in the art. Also the configuration of slot 31 and the edge of the sidewall 18 are selected so that the impact of the bolt on the ramp surface 22 will be alleviated by the inter-engaging features of the ramp, slot and sidewall.

The ramp element 20 defines channel 30 at an intermediate location which, when the ramp is installed, aligns with the center of the bolt of a non-guarded latch bolt or with the dead latch of a guarded latch bolt. The channel 30 allows a dead latch to pass through as the door or closure is opened.

Various arrangements for adjustability securing the ramp element 20 to the housing 10 are shown in FIGS. 6 through 10 which, in each embodiment, depict a ramp element 20 having a channel or pathway 30 for the latch itself.

Figure 6:
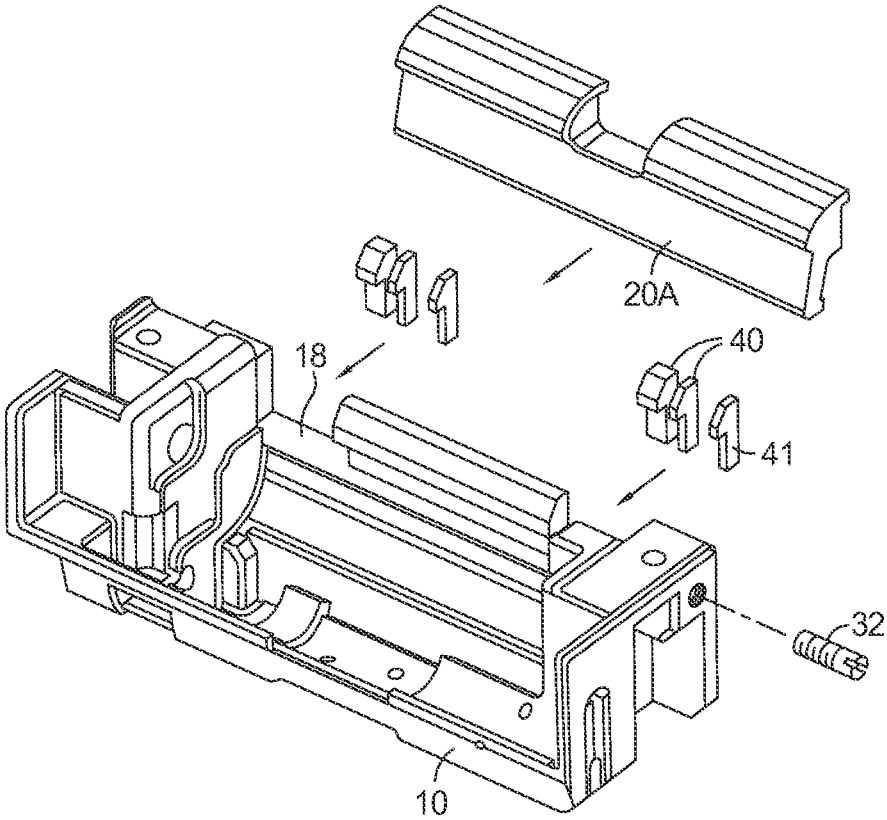
FIGS. 6, 7, 8, 9, 9A and 10 illustrate various ways in which the ramp may be simply secured to the strike housing.

In FIG. 6, the ramp element 20A is slidably adjustable along sidewall 18 of the strike housing 10 by positioning selected shims 40 adjacent one or both ends of the ramp element 20A and the housing. The shims 40 have varying thicknesses and have recesses 41 to engage the housing wall. The shims 40 and the ramp element 20A are locked in place by setscrew 32.

Figure 7:
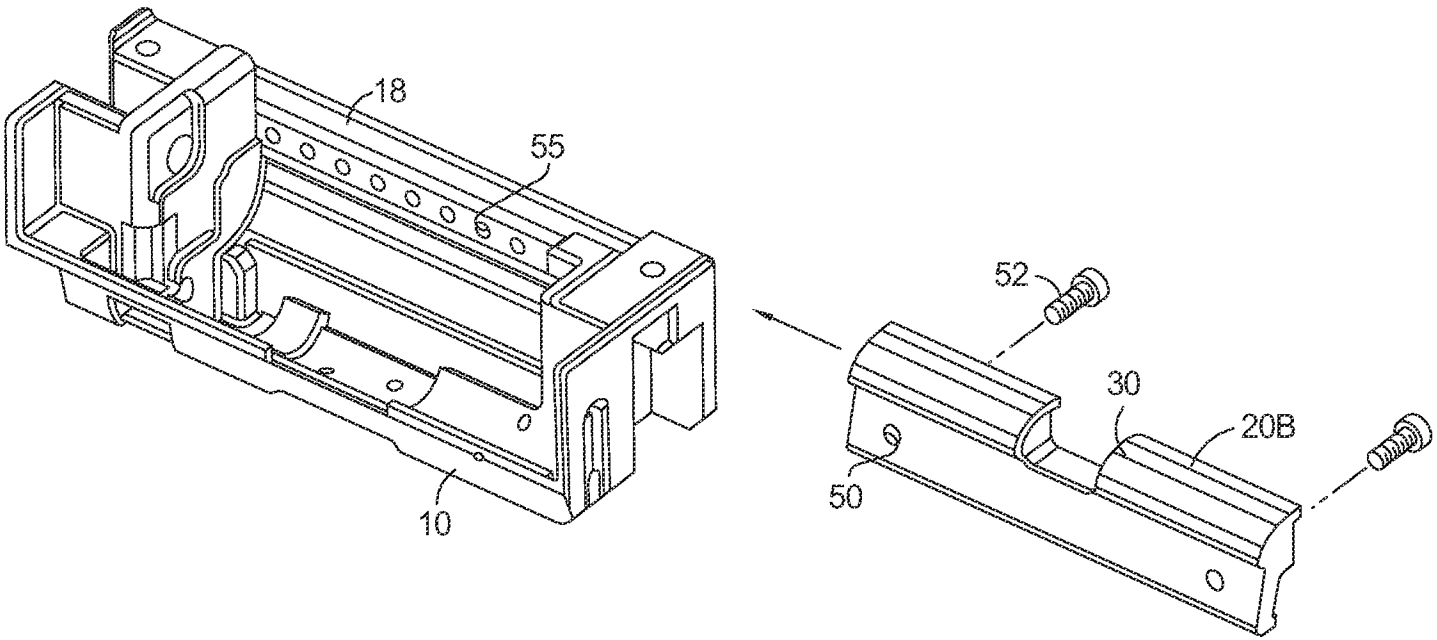

In FIG. 7, the ramp element 20B has clearance bores 50 that receive screws 52 which are selectively alignable with tapped bores 55 in sidewall 18 of strike housing 10.

Figure 8:
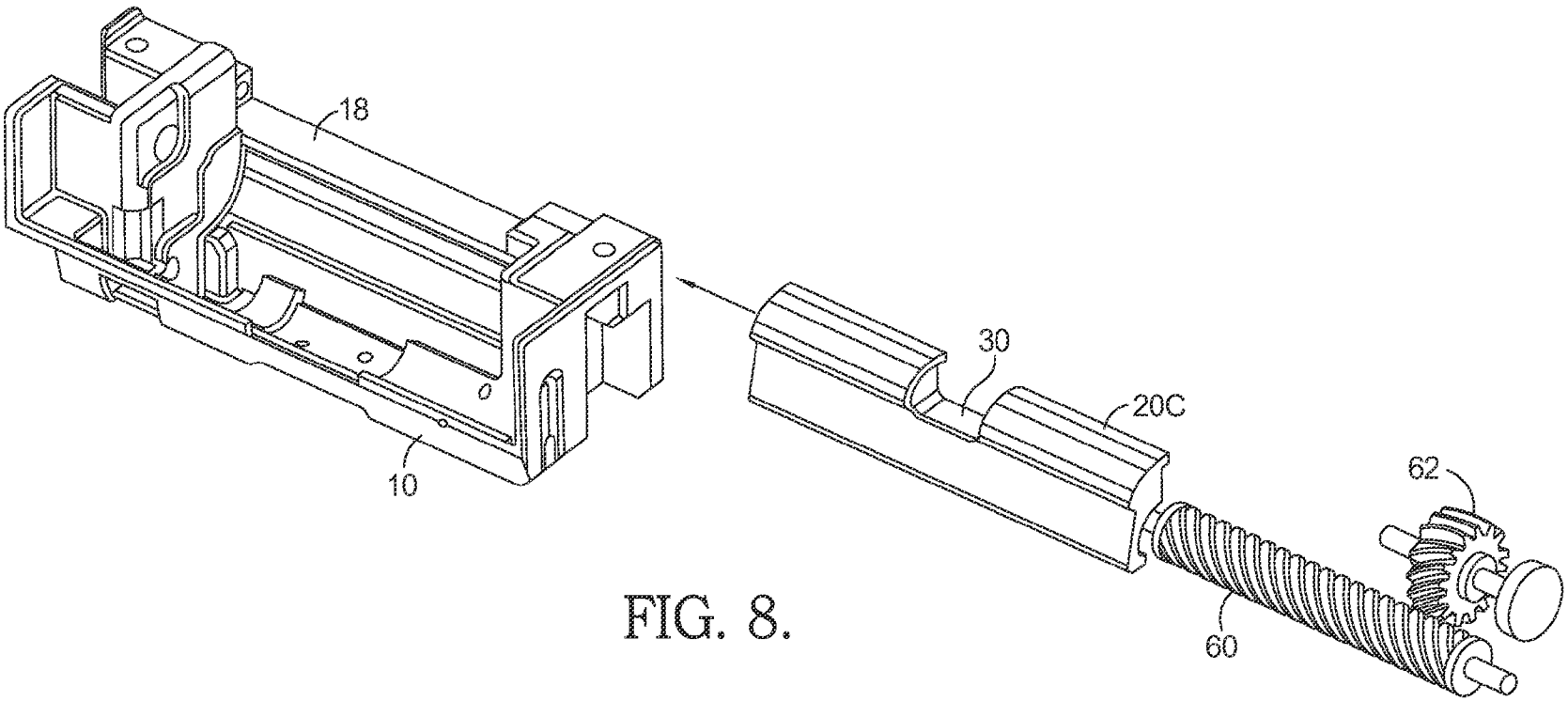

Referring to FIG. 8, a lead screw 60 is rotatably secured to one and of ramp element 20C. Rotation of the lead screw 60 by a tool or gear 62 will advance or retract the ramp element 20C along the sidewall 18 of strike housing 10 to properly position and secure the ramp element 20C relative to the faceplate and the door or closure and latch bolt with dead latch.

Figure 9A:
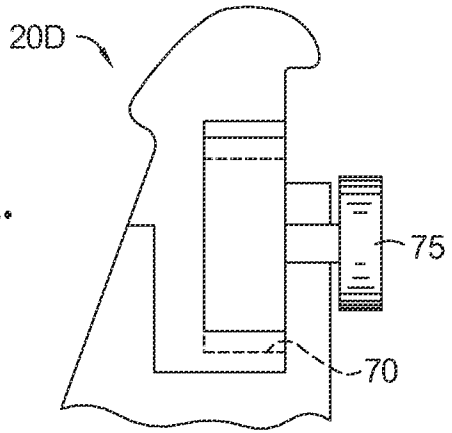
Figure 9:
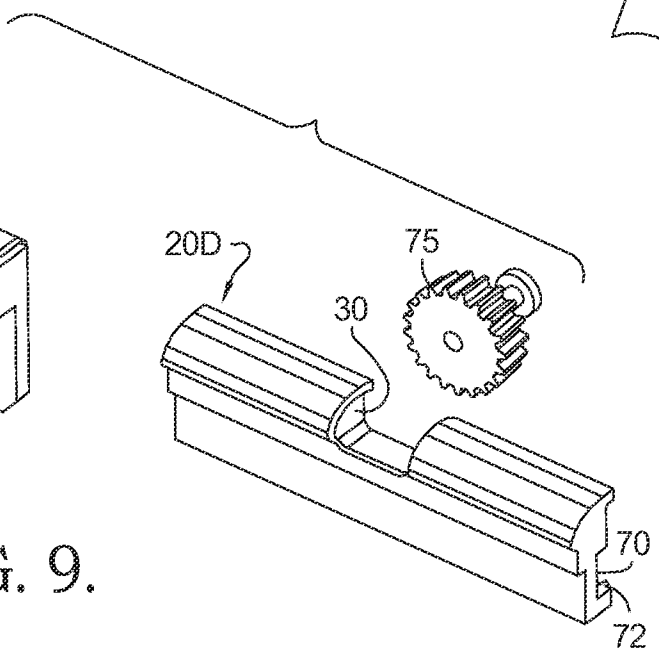
Figure 9:
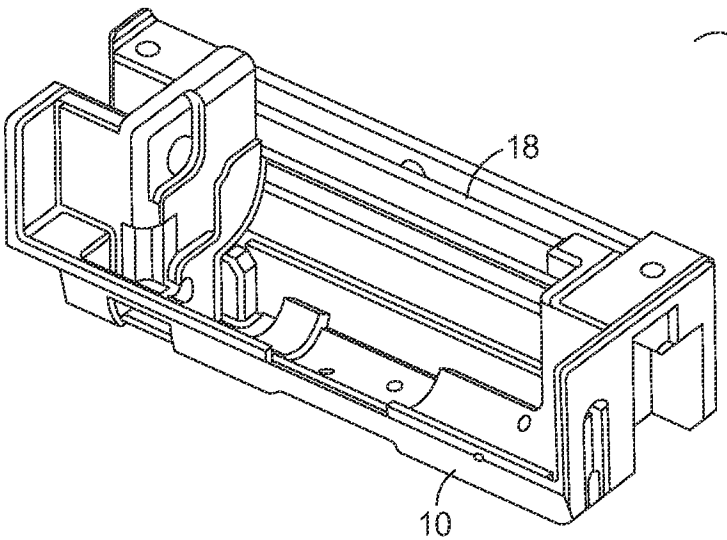

In FIGS. 9 and 9A, the ramp element 20D contains a linear gear rack 70 on one side having teeth 72. Rotation of spur gear 75 will move ramp element 20D bi-directionally along the housing sidewall to the desired alignment position.

Figure 10:
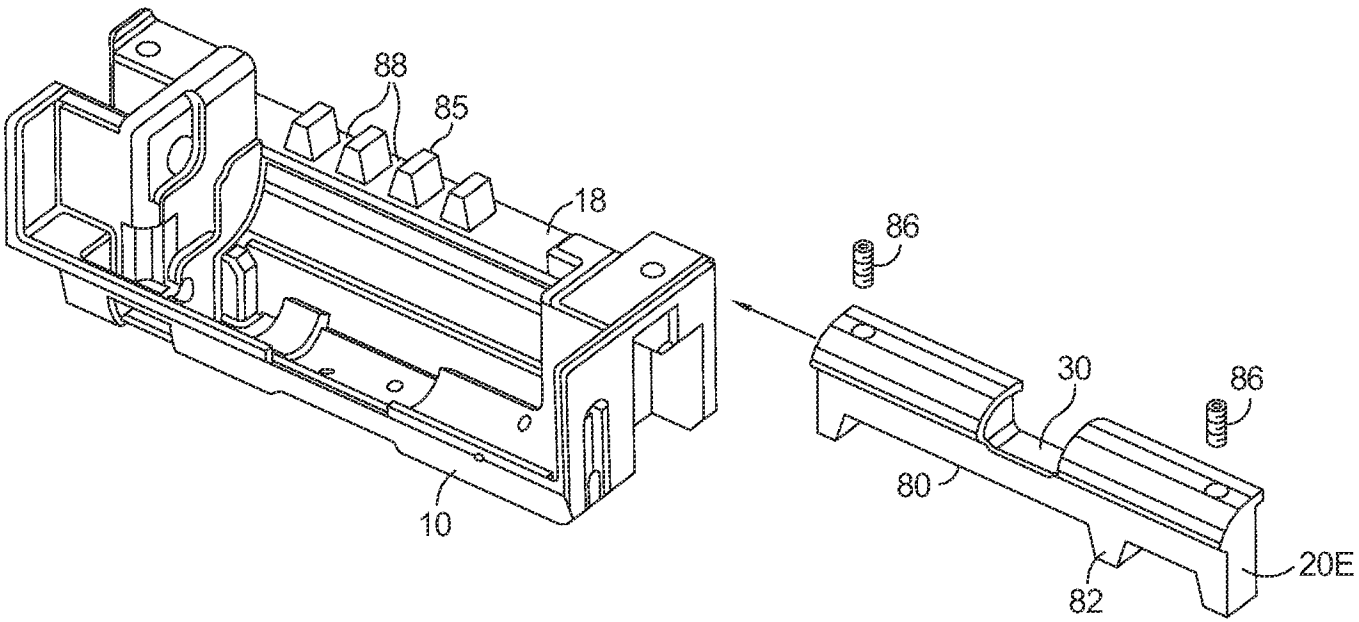

In FIG. 10, the ramp element 20E has a recess 80 with a projection or lug 82. A series of lugs or teeth 85 on the sidewall 18 of housing 10 define spaces 88 therebetween which are selectively engageable with lug 82. Once the desired position is achieved, the ramp element 20E is fixed in place by fasteners 86.

Ramp element 20E can be readjusted if necessary by removing the faceplate to access the fasteners. Once the adjustment is made, the faceplate is reattached to the strike housing. The adjustment feature, such as set screws 86, are concealed by the faceplate plate and not readily accessible.

The faceplate 19 is designed to allow the latch bolt, with or without a guarded latch, to ramp over the leading edge of ramp 39 upon contact, during closing of the door or closure, depressing the latch bolt into the door and then releasing the latch bolt into the housing cavity, thus holding and securing the latch bolt and door or closure in the closed position.

This invention utilizes the basic ramping features found on ramp 39 of the faceplate 19 for closing and securing the door or closure, and further incorporates a ramping feature in the strike housing cavity to ramp and depress the latch bolt back into the door or closure when opening the door or closure. Dual ramping, front ramping face for closing and interior ramps for opening, by itself will not retain the latch bolt and door in a secured condition. However, when coupled with the latch bolt-dead latch linkage in the lock set of the door or closure and the keeper arm of the electric strike, the dead latch, and the latch bolt will hold the door or closure securely in the closed and locked position.

Operation

Referring to FIGS. 4 and 5, a cross-section of the electric strike is shown. Ramp element 20 is adjustably mounted on the strike housing sidewall 18 along longitudinal axis 23 to properly align channel 30 with the latch bolt and dead latch by various fastening arrangements, as have been previously described. When the door or closure is closed the latch bolt will first encounter the ramp 39 on the strike plate and will be depressed. The latch bolt 24 will drop or extend into a captured position in the housing cavity, as seen in FIG. 4, and the dead latch 14 will be engage by the keeper 12 to maintain it in a retracted position to prevent the bolt 24 from being forced externally into the retracted, unlocked position.

When the electric strike is actuated to an unlocked condition, the keeper 12 will rotate to the position shown in FIG. 5 allowing the dead latch 14 to fully extend placing it in a position which will allow the latch bolt 24 to be uninhibited from retracting into the door. When the door or closure is opened the tip of the latch bolt will initially pass over the keeper ramp surface 13 and transition onto ramp surface 22A of the ramp element 20. The initial section 22A of ramp surface 22 is generally planar and is disposed at an angle of between 30 and 45°.

The ramp surface 22 then becomes arcuate along region 22B. The keeper 16 aligns with channel 30 in the ramp 22. Accordingly, the planar and angular surfaces of the keeper 12 and ramps 20 and 39 overlap as the latch bolt passes from the keeper 12 to the ramp element 20 and from the ramp element 20 to the faceplate 19 to facilitate smooth passage of the bolt, providing a shingling affect to prevent the bolt from hanging up. The keeper ramp surface 13 aligns with entry surface 22A of the ramp in the open position shown in FIG. 5 having an angular orientation between 30 and 45°.

It will be obvious to those skilled in the art to make various changes, alterations and modifications to the invention described herein. To the extent such changes, alterations and modifications do not depart from the spirit and scope of the appended claims, they are intended to be encompassed therein.

The invention claimed is:

1. A method for aligning a dead latch with an electric strike disposed in a door frame, the electric strike being operatively associated with a latch assembly disposed in a door, the latch assembly including a latch bolt, the dead latch, and a latch faceplate having a planar surface, the electric strike defining a strike cavity and having a longer longitudinal length than a width, the electric strike including a ramp element proximal to the strike cavity, the ramp element including a ramp surface, a channel defined in the ramp surface, and an axis extending in a direction parallel to the ramp surface and the longitudinal length of the electric strike along the ramp element, the method comprising:

identifying a misalignment between the channel and the dead latch, wherein the channel and the dead latch are misaligned when the dead latch is not permitted to pass through the channel as the door is moved from a closed position in a door opening direction; and selectively positioning the ramp element, and thereby the channel, relative to the dead latch so that the channel is aligned with the dead latch when the door is in the closed position to permit the dead latch to pass through the channel as the door is moved from the closed position in the door opening direction, wherein the channel is selectively positioned relative to the dead latch along the axis of the ramp element and in a plane parallel to the planar surface of the latch faceplate when the door is in the closed position.

2. A method in accordance with claim 1, wherein the ramp surface is a first ramp surface, wherein the electric strike further comprises a keeper including a second ramp surface, the keeper having a first position and a second position, the method further comprising:

selectively positioning the keeper in the first position to maintain the dead latch in a retracted position; and selectively positioning the keeper in the second position to allow the dead latch to be released from its retracted position.

3. A method in accordance with claim 2, the electric strike further comprising a strike faceplate, wherein the second ramp surface in the second position is disposed at an angle between 30 and 45 degrees relative to the strike faceplate.

4. A method in accordance with claim 2, further comprising:

aligning the second ramp surface with the first ramp surface to provide a shingling effect to facilitate smooth passage of the latch bolt from the second ramp surface onto the first ramp surface when the keeper is in the second position.

5. A method in accordance with claim 1, wherein the electric strike includes a housing that defines the strike cavity, wherein the method further comprises:

adjustably securing the ramp element to the housing by at least one fastener selected from the group consisting of screws, clamps, jaws, pins, springs, shims and gears.

6. A method in accordance with claim 5, wherein the ramp element defines a slot, and wherein the ramp element is engaged with a sidewall of the housing.

7. A method in accordance with claim 6, wherein the slot and the sidewall have inter-engaging sections.

8. A method in accordance with claim 6, wherein the sidewall includes a shoulder, and wherein the slot engages the shoulder to allow the ramp element to be adjusted along the axis.

* * * * *